United States Patent [19]

Altmann et al.

[11] Patent Number: 4,523,171

[45] Date of Patent: Jun. 11, 1985

[54] DRY-TYPE TRANSFORMER WITH WINDINGS CAST IN CASTING RESIN

[75] Inventors: Gerhard Altmann, Kirchheim; Friedrich Alber, Köngen; Lothar Brzuska, Wernau, all of Fed. Rep. of Germany

[73] Assignee: Transformatoren Union AG, Stuttgart, Fed. Rep. of Germany

[21] Appl. No.: 520,720

[22] Filed: Aug. 5, 1983

[30] Foreign Application Priority Data

Aug. 6, 1982 [DE] Fed. Rep. of Germany ..... 3229480

[51] Int. Cl.[3] ..... H01F 27/02

[52] U.S. Cl. ..... 336/96; 336/60; 336/205

[58] Field of Search ..... 336/60, 96, 197, 205

[56] References Cited

U.S. PATENT DOCUMENTS

| | | | |
|---|---|---|---|
| 2,677,810 | 5/1954 | Lennox | 336/60 X |
| 2,685,677 | 8/1954 | Paluev | 336/60 X |
| 2,756,397 | 7/1956 | Cederstrom et al. | 336/60 |
| 2,783,441 | 2/1957 | Camilli et al. | 336/60 X |
| 4,129,938 | 12/1978 | Hagenbucher | 336/96 X |

FOREIGN PATENT DOCUMENTS

| | | |
|---|---|---|
| 2246235 | 1/1977 | Fed. Rep. of Germany . |
| 2104112 | 9/1978 | Fed. Rep. of Germany . |
| 1426135 | 2/1976 | United Kingdom . |

*Primary Examiner*—A. D. Pellinen
*Assistant Examiner*—Susan Steward
*Attorney, Agent, or Firm*—Herbert L. Lerner; Laurence A. Greenberg

[57] ABSTRACT

A dry-type transformer cast into casting resin, includes windings, a main leakage canal, at least one of the windings being subdivided into coaxial winding parts spaced apart from each other defining an additional axial cooling canal therebetween, separate inner and outer casting resin bodies each having end faces and being cast around a respective one of the winding parts, reinforcements formed on diametrically opposite outer surface regions of the outer casting resin body for receiving axially extended connecting conductors for electrically wiring the winding parts, line terminals and tap terminals disposed on respective reinforcements, and elastic blocks common to all of the windings and winding parts between which the winding parts of a respective winding are clamped and metallically interconnected in front of the end faces of the casting resin bodies.

9 Claims, 4 Drawing Figures

DRY-TYPE TRANSFORMER WITH WINDINGS CAST IN CASTING RESIN

BACKGROUND OF THE INVENTION

1. Field of the Invention

The invention relates to a dry-type transformer with windings cast in casting resin and with at least one axial cooling canal provided in addition to the main leakage canal, preferably in the winding located radially outside the main leakage canal.

2. Description of the Prior Art

In the course of expansion and optimization of electric power distribution networks, it is frequently desired to increase the nominal voltage and/or the unit power rating of transformers. In many cases dry-type transformers are employed. Their unit rating and nominal voltage, however, have an upward limit. The reason for this is firstly because problems arise when removing heat from the core and the windings and secondly because the unit weights of the windings encapsulated by the casting resin as well as the casting resin body enclosing the windings are also subject to limitations for physical and technical reasons.

German Published, Prosecuted Application DE-AS No. 21 04 112 discloses a casting-resin insulated transformer winding with additional axial cooling canals located within the casting resin body. However, the manufacture of such casting-resin bodies enclosing windings is very costly from a production point of view. In addition, nothing substantial is changed in the practical operation between the unit weight of the casting resin body and the nominal power rating of the transformer in this conventional winding structure. In principle, nothing is changed as well if the winding is axially subdivided into several winding sections. For technically usable and sufficiently economical production of higher and higher nominal power ratings of casting resin transformers, farther-reaching solutions are therefore required.

SUMMARY OF THE INVENTION

It is accordingly an object of the invention to provide a dry-type transformer with windings cast in casting resin, which overcomes the hereinafore-mentioned disadvantages of the heretoforeknown devices of this general type, to do so in such a way that cooling canals are formed by the disposition of the parts alone, that all of the parts can be produced without particular difficulty using conventional methods, and that even at that, a substantial increase of the maximally possible unit power ratings of the transformer provided with this winding structure are assured without increasing the unit weights of the casting resin bodies.

With the foregoing and other objects in view there is provided, in accordance with the invention, a dry-type transformer cast into casting resin, comprising windings, a main leakage canal, at least one of said windings, preferably disposed radially outside the main leakage canal, being subdivided into coaxial winding parts spaced apart from each other defining an additional axial cooling canal therebetween, separate inner and outer casting resin bodies from separate molds each having end faces and being cast around a respective one of the winding parts, conventional reinforcements formed on diametrically opposite outer surface regions of the outer casting resin body for receiving axially extended connecting conductors for electrically wiring said winding parts, i.e. shifted 180° from each other in circumferential direction, line terminals and tap terminals disposed on respective reinforcements, and elastic blocks common to all of the windings and winding parts between which the winding parts of a respective winding are clamped and metallically interconnected in front of the end faces of the casting resin bodies after assembly of the winding parts.

While it is already known from German Publiched, Prosecuted Application DE-AS No. 22 46 235, corresponding to British Patent GB-PS No. 1,426,217, to clamp the transformer windings enclosed in casting resin between elastic blocks common to all windings, a one-piece construction (in the radial direction) of each of the windings of the transformer is assumed to be present in this conventional structure. This assumption is also met by axially subdivided windings, having sections which are mechanically connected to each other.

In accordance with another feature of the invention, the windings include a winding disposed radially inwardly from and spaced apart from the winding parts defining the main leakage canal therebetween.

In accordance with a further feature of the invention, the radially inner winding is a low-voltage winding and the winding subdivided into winding parts is a high-voltage winding.

In accordance with an added feature of the invention, the winding subdivided into winding parts is a high-voltage winding and is disposed radially outwardly from another of said windings, the inner casting resin body is disposed between the main leakage canal and the additional axial cooling canal and is constructed for a given full nominal or rated voltage, and the outer casting resin body is disposed radially outwardly from the additional cooling canal and is constructed for substantially half of the given nominal or rated voltage.

In accordance with an additional feature of the invention, the winding parts are electrically interconnected in series and have input turns lying in spacially adjacent winding ends.

In accordance with again another feature of the invention, there are provided metallic connections, the winding parts being constructed of respective individual coils interconnected in series by the metallic connections, the inner casting resin body having a pouring hole formed therein defining a strip on the outer surface of the inner casting resin body accommodating the metallic connections of the individual coils of the winding part in the inner casting resin body, and the metallic connections of the individual coils of the winding part in the outer casting resin body being accommodated in the reinforcement carrying the line terminals.

In accordance with again a further feature of the invention, the winding parts do not touch each other and have air insulation gaps formed therebetween in assembled condition.

In accordance with again an added feature of the invention, there are provided winding conductor ends connecting the winding parts, and insulating material accommodating the winding conductor ends in vicinity of the end faces of the casting resin bodies and sealing the winding conductor ends to the casting resin bodies, during the casting process.

In accordance with yet a further feature of the invention, the insulating material is in the form of insulating tubes.

In accordance with a concomitant feature of the invention, the casting resin bodies have a substantially circular ring-shaped cross section. Support straps are not necessary and would, in addition, have an adverse effect on the dielectric strength in the cooling canal.

Dry-type transformers constructed in accordance with the invention are very advantageous because they permit an increase of the rated power of casting-resin insulated transformers while retaining the production facilities and production methods already customary heretofore for their manufacture.

Other features which are considered as characteristics for the invention are set forth in the appended claims.

Although the invention is illustrated and described herein as embodied in a dry-type transformer with windings cast in casting resin, it is nevertheless not intended to be limited to the details shown, since various modifications and structural changes may be made therein without departing from the spirit of the invention and within the scope and range of the equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENT

Figure 1:
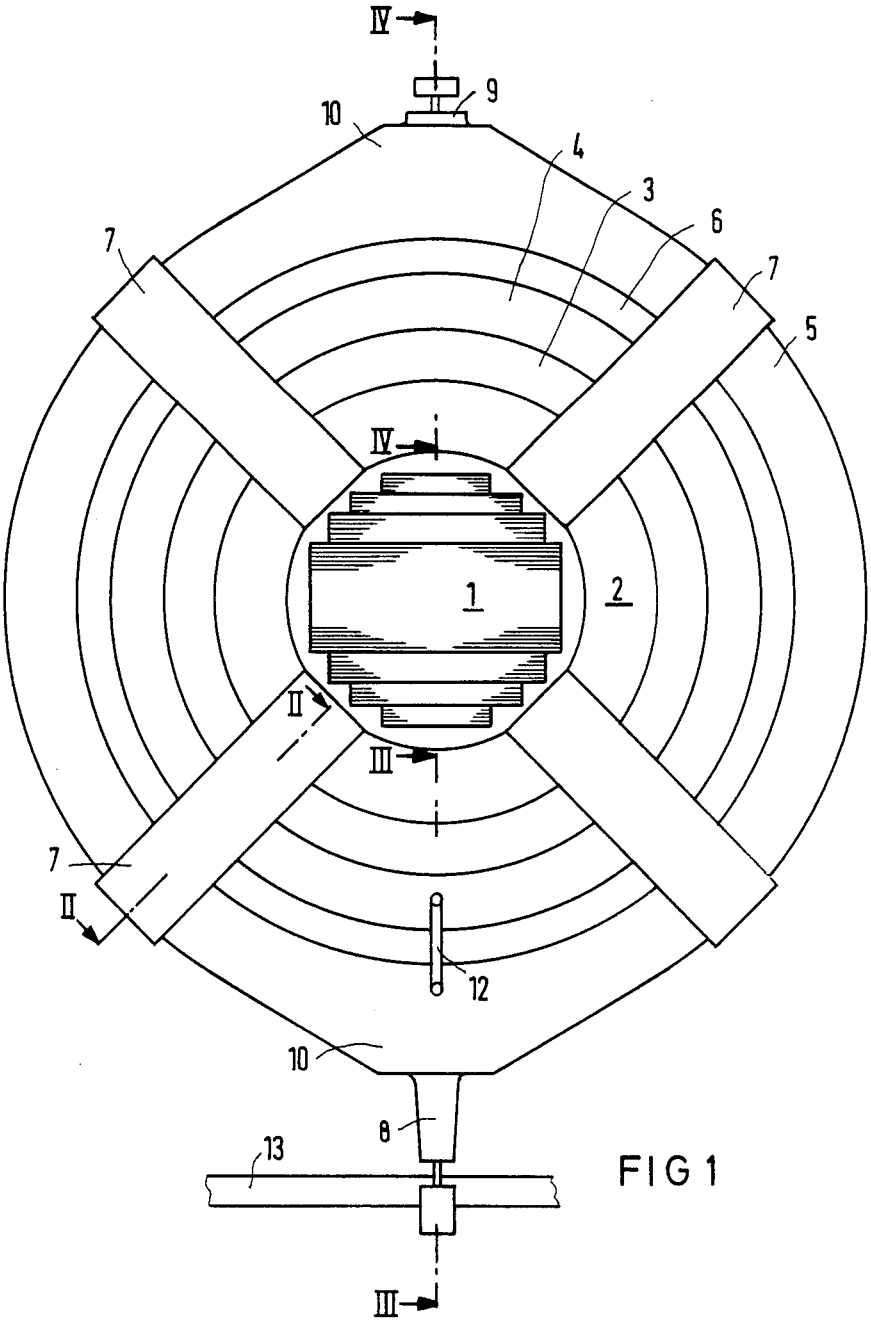
FIG. 1 is a fragmentary, diagrammatic, top plan view of a winding device according to the invention.
Figure 2:
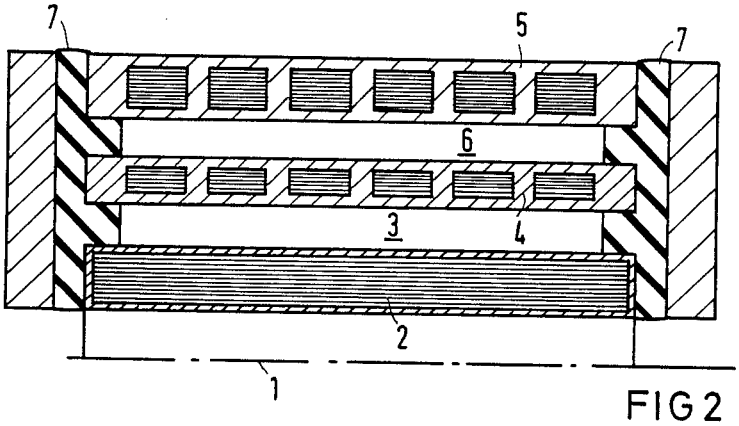
FIG. 2 is a cross-sectional view of the winding device, taken along the line II—II in FIG. 1, in the direction of the arrows, parallel to the axis in vicinity of blocks holding the windings.

Referring now to the figures of the drawing in detail and first particularly to FIGS. 1 and 2 thereof, it is seen that a low-voltage winding 2, a high-voltage winding of an inner winding part 4, as well as a high-voltage winding of an outer winding part 5, are disposed radially from the inside out around a laminated iron core 1. The low-voltage winding 2 and the inner winding part 4 enclose a main leakage canal 3 which simultaneously acts as a cooling canal. The winding parts 4 and 5 of the high-voltage winding which fit coaxially within each other, flank an additional cooling canal 6. In view of the better heat removal from the outer winding part 5, somewhat more than half of the turns of the high-voltage winding are disposed therein.

The low-voltage winding 2 as well as the winding parts 4 and 5 are held in their assembled position by partially elastic blocks 7. On one hand, projections of the blocks 7 engage the main leakage canal 3 and the additional cooling canal 6 as shown in FIG. 2, and on the other hand, the blocks 7 are braced against a clamping frame which also holds the iron core together, in a manner not shown in detail. The elastic blocks 7 are distributed substantially uniformly over the periphery of the low-voltage winding 2 as well as the winding parts 4 and 5 and preferably form an angle of approximately 45° with the longitudinal axis of the transformer.

Figure 4:
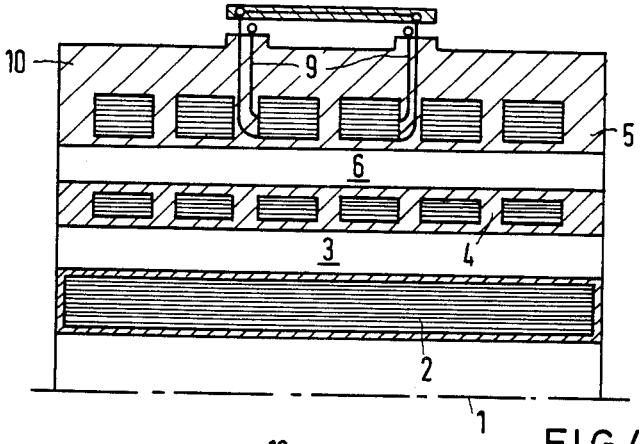
FIG. 4 is another similar view taken along the line IV—IV in FIG. 1, in vicinity of tap terminals.
Figure 3:
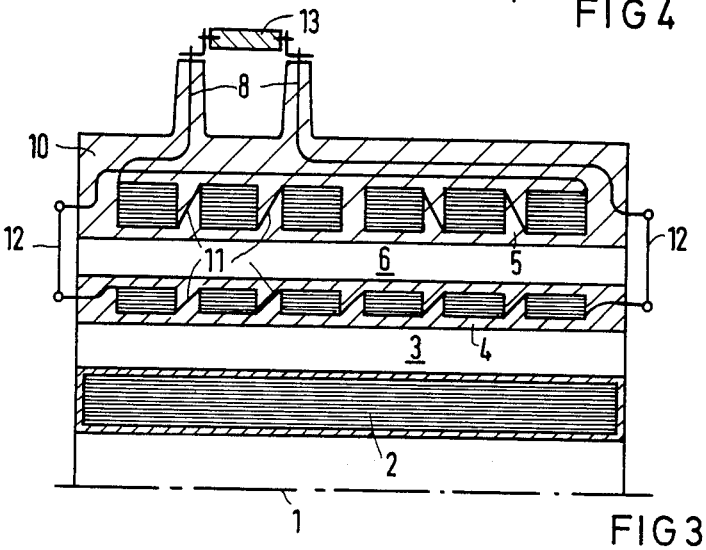
FIG. 3 is a view similar to FIG. 2, taken along the line III—III in FIG. 1, in vicinity of line terminals.

The sections of the winding device parallel to the axis shown in FIGS. 3 and 4 each enclose an angle of 90° with the longitudinal axis of the transformer and show the disposition of line terminals 8 and tap-off terminals 9, respectively. In addition, coil connections 11 for the metallic connection of the individual coils in the winding parts 4 and 5 as well as axially extending connecting conductors for the electrical wiring of the winding parts 4 and 5, are disposed in one plane with the line terminals 8.

The axially extending connecting conductors are brought out of the casting-resin bodies through the end faces thereof and are connected by insulated jumpers 12 to form a so-called single-layer circuit of the two winding parts 4 and 5. Reinforcements 10 of the casting-resin layer at the outer winding part 5 of the high-voltage winding assure the necessary insulating spacing within the casting-resin body. A non-illustrated ridge which is formed simultaneously by the hole for pouring in the casting mold, can be used at the inner winding part 4 for accomodating the coil connections 11. The winding conductor ends brought out from the casting-resin bodies through the end faces thereof in the axial direction, are disposed in tubes of elastic insulating material or of another suitable insulating material which at the same time accomplishes the sealing between the winding conductors and the casting mold.

The line terminals 8 lie on plug-like extensions cast onto the outer casting-resin body and carry a connecting strip 13 which connects the high-voltage windings of the transformer to each other, preferably in a delta-circuit. The jumpers 12 together with the axially extending connecting conductors within one of the reinforcements 10, serve for the above-mentioned preparation of the single-layer circuit of the winding parts 4 and 5. The single-layer circuit forces uniform voltage stress in the amount of about half of the nominal voltage over the entire length of the additional cooling canal 6. The winding part 4 preferably carries the higher voltage in this case, so that the insulation of the winding part 5 need only be constructed for half the nominal voltage, except for the line terminal on the high-voltage side.

A further reinforcement 10 is disposed opposite the line terminals 8, on the other side of the outer winding part 5. Tap-off terminals 9 are disposed on the further reinforcement 10, in likewise radially projecting pads. The tap-off terminals 9 permit matching of the transformation ratio of the transformer to different network loads in steps by means of the jumpers 12, if no voltage is present. To ensure symmetrical field distributions, the tap-off or tapping-off turns are provided in this case in the central individual coils of the outer winding part 5 of the high-voltage winding. Instead of providing two taps, more taps may be used.

The foregoing is a description corresponding in substance to German Application P No. 32 29 480.8, dated Aug. 6, 1982, the International priority of which is being claimed for the instant application, and which is hereby made part of this application. Any material discrepancies between the foregoing specification and the aforementioned corresponding German application are to be resolved in favor of the latter.

We claim:

1. Dry-type transformer cast into casting resin, comprising windings, a main cooling canal, at least one of said windings being subdivided into coaxial winding parts spaced apart from each other defining an additional axial cooling canal therebetween, separate inner and outer casting resin bodies each having end faces and being cast around a respective one of said winding parts, reinforcements formed on diametrically opposite outer surface regions of said outer casting resin body for receiving axially extended connecting conductors for electrically wiring said winding parts, line terminals and tap terminals disposed on respective reinforcements, and elastic blocks common to all of said windings and winding parts between which said winding parts of a respective winding are clamped, said winding parts of a respective winding being metallically inter-connected in front of said end faces of said casting resin bodies.

2. Dry-type transformer according to claim 1, wherein said windings include a winding disposed radially inwardly from and spaced apart from said winding parts defining said main cooling canal therebetween.

3. Dry-type transformers according to claim 2, wherein said radially inner winding is a low-voltage winding and said winding subdivided into winding parts is a high-voltage winding.

4. Dry-type transformer according to claim 1, wherein said winding subdivided into winding parts is a high-voltage winding and is disposed radially outwardly from another of said windings, said inner casting resin body is disposed between said main cooling canal and said additional axial cooling canal and is dimensioned for surrounding a winding carrying a given full nominal voltage, and said outer casting resin body is disposed radially outwardly from said additional cooling canal and is dimensioned for surrounding a winding carrying substantially half of said given nominal voltage.

5. Dry-type transformer according to claim 4, wherein said winding parts are electrically interconnected in series and have input turns lying in spacially adjacent winding ends.

6. Dry-type transformer according to claim 1, including metallic connections, said winding parts being constructed of respective individual coils interconnected in series by said metallic connections, a strip on the outer surface of said inner casting resin body accommodating said metallic connections of said individual coils of said winding part in said inner casting resin body, and said metallic connections of said individual coils of said winding part in said outer casting resin body being accommodated in said reinforcement carrying said line terminals.

7. Dry-type transformer according to claim 1, including winding conductor ends connecting said winding parts, said casting resin bodies being formed of insulating material accommodating said winding conductor ends in vicinity of said end faces of said casting resin bodies and sealing said winding conductor ends to said casting resin bodies.

8. Dry-type transformer according to claim 7, wherein said insulating material is in the form of insulating tubes.

9. Dry-type transformer according to claim 1, wherein said casting resin bodies have a substantially circular ring-shaped cross section.

* * * * *